US005086974A

United States Patent [19]

Henshaw

[11] Patent Number: 5,086,974

[45] Date of Patent: Feb. 11, 1992

[54] CAVITATING JET NOZZLE

[75] Inventor: Terry L. Henshaw, Battle Creek, Mich.

[73] Assignee: NLB Corp., Wixom, Mich.

[21] Appl. No.: 629,214

[22] Filed: Dec. 18, 1990

[51] Int. Cl.[5] ..... E21B 7/18

[52] U.S. Cl. ..... 239/101; 239/590; 175/67; 175/424

[58] Field of Search ..... 239/590, 499, 518, 11, 239/590.3, 590.5, 594, 381, 101; 175/424, 67; 134/22.12, 198

[56] References Cited

U.S. PATENT DOCUMENTS

| | | | |
|---|---|---|---|
| 1,165,240 | 12/1915 | Gault et al. | 239/518 |
| 3,528,704 | 9/1970 | Johnson, Jr. | 175/67 |
| 3,713,699 | 1/1973 | Johnson, Jr. . | |
| 3,807,632 | 4/1974 | Johnson, Jr. | 175/67 |
| 4,172,690 | 10/1979 | Kuntz | 415/199.2 |
| 4,262,757 | 4/1981 | Johnson, Jr. et al. | 175/424 |
| 4,389,071 | 6/1983 | Johnson, Jr. et al. . | |
| 4,391,339 | 7/1983 | Johnson, Jr. et al. | 175/424 |
| 4,474,251 | 10/1984 | Johnson, Jr. | 239/101 |
| 4,542,798 | 9/1985 | Madigan | 175/424 |
| 4,821,961 | 4/1989 | Shook . | |

FOREIGN PATENT DOCUMENTS

| | | | |
|---|---|---|---|
| 655286 | 2/1935 | Fed. Rep. of Germany | 239/590 |
| 403191 | 6/1966 | Switzerland | 239/251 |

OTHER PUBLICATIONS

Cleaning and Cutting with Self-Resonating Pulsed Water Jets, Hydronautics, Incorporated, Laurel, Md. 20707.

The Centerbody Cavijet, Tracor Hydronautics, Laurel, Md. 20707.

Industrial Applications for Rotating Nozzle Technology, M. T. Gracey NLB Corporation, Wixom, Mich. 48096.

Rapid Cutting of Pavement with Cavitating Water Jets, Andrew F. Conn Tracor Hydronautics, Inc. Laurel, Md. U.S.A.

Some Unusual Applications for Cavitating Water Jets, Andrew F. Conn Tracor Hydronautics, Inc., Laurel, Md., U.S.A.

An Automated Explosive Removal System Using Cavitating Water Jets, Andrew F. Conn, Tracor Hydronautics, Inc. Laurel, Md., U.S.A.

A Material Failure Model for Pulsed Jet Impact, Thomas J. Labus, University of Wisconsin-Parkside Engineering Science.

Research Facilities Using Cavitating Water Jet Techniques to Test Materials, Michael T. Gracey and Andrew F. Conn, Tracor Hydronautics.

Cavitation Erosion Used for Material Testing, Gracey and Conn, Jet Technology Systems Division of Tracor Hydronautics, Inc.

Sandroid Systems, Inc., Division of Mobile Robot Corporation Gary K. Sweet, Vice President.

The Application of High Pressure Water Jet Technology, David Summers University of Missouri-Rolla, May 23, 1983.

*Primary Examiner*—Andres Kashnikow
*Assistant Examiner*—Christopher C. Trainer
*Attorney, Agent, or Firm*—Dykema Gossett

[57] ABSTRACT

A cavitating jet nozzle is disclosed for producing cavitation in a pressurized fluid such as a water used to clean a surface. The cavitating jet nozzle includes a pin received at a central position which lowers the pressure of the pressurized fluid such that cavitation bubbles form in the fluid. The pin is free-floating relative to a securing member which retains the pin in the nozzle, and is thus self-centering. The inventive cavitating nozzle is easily maintained since the pin is self-centering and need not be repeatedly centered. The pin preferably has an end face upstream of an outlet portion of the nozzle.

19 Claims, 1 Drawing Sheet

CAVITATING JET NOZZLE

BACKGROUND OF THE INVENTION

This application relates to an improved nozzle for applying a fluid to a surface to be cleaned. More particularly, this invention relates to such a nozzle in which a member is self-centering within the nozzle to create cavitation and apply a cavitating jet to efficiently and thoroughly clean the surface.

Modern cleaning systems often use a fluid jet to remove rust, scale or coatings from a surface to be cleaned. Typically, these surfaces are cleaned by the application of a fluid which carries an abrasive substance, such as sand. The use of a fluid carrying an abrasive is well known and commonly utilized to clean surfaces such as metal down to a bare metal surface. In many prior art systems, the use of a fluid without an abrasive material would not effectively clean the surface.

It is sometimes undesirable to use an abrasive carried in a fluid, since the abrasive may escape from the fluid and be mixed into the air surrounding the cleaning area. Further, the abrasive material may get into nearby machinery. Further, the abrasive material may contaminate environmental air and/or water. All these results are undesirable. For this reason, it is desirable to develop a cleaning system that utilizes a fluid jet which does not carry an abrasive material.

It is known in the prior art to utilize cavitation to increase the cleaning power of a fluid jet. Essentially, the principle of cavitation involves lowering the pressure of a fluid below its vapor pressure. As the fluid reaches pressures below the vapor pressure, bubbles of vaporized fluid form in the jet. As the jet strikes a surface to be cleaned, these bubbles implode and remove rust, scale or other coating. Cavitation may be undesirable in pumping fluids and for other fluid applications, however, it is beneficial in cleaning applications.

Problems exist with prior art nozzles which utilize cavitation since it is difficult to cause an adequate cavitation effect in a mass produced nozzle. It should be appreciated that in order for the nozzle to actually produce substantial cavitation bubbles, internal members must be accurately formed and positioned.

In some prior art devices, a pin member was received in the nozzle to lower the pressure of the fluid, thereby creating cavitation. It has been found that this pin member should be accurately positioned within the nozzle and centered along a nozzle center axis. Due to the relatively small sizes of the pins and nozzles which have been utilized, it is very difficult to center, and maintain the pins centered within the nozzles. This has resulted in the prior art cavitating nozzles being less efficient than desired.

In the prior art, the pin is typically secured within the nozzle bore by a thread connection. This provides insufficient accuracy in the axial position of the pin, which is an important variable in the efficiency of a cavitation nozzle. In addition, since these prior art pins were typically fixed relative to the nozzle, close attention was required during assembly to ensure that the pins were centered within the nozzle. Further, these fixed pins often moved off-center with use, which decreased the efficiency of the cavitating nozzles.

It is therefore an object of the present invention to provide a cavitating nozzle which receives a self-centering pin. It is further an object of the present invention to provide such a nozzle in which the pin is accurately positioned axially within the nozzle. It is further an object of the present invention to provide such a nozzle in which the axial position of the pin within the nozzle is less critical.

SUMMARY OF THE INVENTION

In a disclosed embodiment of the present invention, a cavitating nozzle includes a throat with a first conically decreasing bore leading into a second bore, which leads to an outlet. A pin is centered within the first bore, and a pressurized fluid supply is communicated to the outer periphery of the pin. The pin, in combination with the first bore, lowers the pressure of the pressurized fluid such that it is below the vapor pressure for its temperature, which produces cavitation. Bubbles form in the fluid jet and flow outwardly of the nozzle to strike a surface to be cleaned. In a disclosed embodiment, the pin is free-floating such that it is self-centering within the bore.

In a preferred embodiment, a pin securing member is received axially adjacent to one end of the first bore, and includes a central pin aperture of a first diameter greater than the outer diameter of a pin received in the pin aperture. Since the pin diameter is less than the diameter of the pin aperture, the pin is free-floating within the aperture. Due to a basic fluid phenomena known as the Lomakin effect, the pin remains at the center of the first bore. Essentially, the Lomakin effect occurs with a center member surrounded by a fluid moving axially past the center member. The member will tend to remain centered, since if it moves off center, the pressure on the side it is moving towards will increase relative to the pressure on the side it is moving away from, and the member will be urged back towards the center. Due to this effect, the inventive free-floating pin is self-centering within the first bore.

Preferably, the pin securing member abuts an end of the throat such that the pin is accurately positioned axially within the throat. Because of the small angle on the sides of the conical first bore, the flow area at the tip of the pin varies slowly with axial location. This broadens the range of effective axial locations of the tip of the pin, resulting in less-critical axial location of the tip. The pin securing member is preferably secured by an adhesive within a nozzle housing, which also receives the throat.

In a most preferred embodiment of the present invention, the pin securing member includes a plurality of fluid ports spaced circumferentially about, and radially outwardly, of the pin aperture. A pressurized fluid is led into these ports and passes through the first bore outside of the pin to the second bore and the outlet.

In a most preferred embodiment of the present invention, the pin ends at a point within the conically converging first bore and defines an end face. The first bore could be said to have an inlet at an upstream end and an outlet at the downstream end. The end face of the pin is located somewhere between the inlet and outlet. In a most preferred embodiment, the end face is of a cross-sectional area approximately equal to the cross-sectional area of the first bore at the outlet end. In addition, in a most preferred embodiment, the cross-sectional flow area between the pin and the first bore at the end face is approximately equal to the cross-sectional area of the end face at the outlet port. The cavitation produced in the fluid jet at this pin position is quite good.

These and other objects and features of the present invention can be best understood from the following specification and drawings of which the follow is a brief description.

DETAILED DESCRIPTION OF A PREFERRED EMBODIMENT

Figure 1:
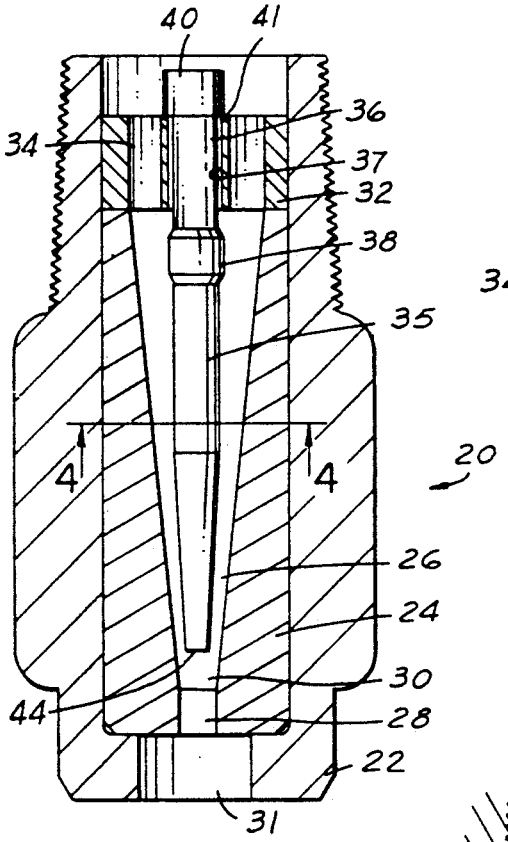
FIG. 1 is a cross-sectional view through a cavitating jet nozzle according to the present invention.

Cavitating jet nozzle 20 can be understood from FIGS. 1-5. As shown in FIG. 1, nozzle 20 includes nozzle housing 22 which receives throat 24. Throat 24 defines a first conically decreasing bore 26 which leads into second bore 28. First bore 26 has inlet 29 of a first diameter and outlet 30 of a second diameter smaller than the first diameter. The diameter of second bore 28 is preferably identical to the diameter of outlet 30 throughout its length. Housing outlet 31 leads from nozzle housing 22 such that a fluid can be applied to a surface to be cleaned.

Pin securing member 32 is connected with an adhesive to nozzle housing 22 and abuts an end of throat 24 such that pin securing member 32 is easily and accurately positioned. Preferably, Loctite TM type adhesive is utilized. Pin securing member 32 includes a plurality of ports 34 spaced outwardly of pin 35. Pin 35 includes portion 36 received within central pin aperture 37 in pin securing member 32. The inner diameter of central pin aperture 37 is greater than the outer diameter of pin portion 36. Thus, pin 35 can float radially within central pin aperture 37. This allows pin 35 to be self-centering with respect to pin securing member 32, and also with respect to first bore 26, as will be described below.

Lower pin stop 38 is formed on one end of pin portion 36 and upper pin stop 40 is formed on the other end. The outer diameters of upper and lower pin stops 40 and 38 are preferably greater than the inner diameter of central pin aperture 37 such that pin 35 cannot pass through central pin aperture 37, but is retained within pin securing member 32.

As a preferred alternative to lower pin stop 40, a roll pin could be positioned above upper pin stop 40 to prevent removal of pin 35. As an example, housing 22 could extend further upwardly than shown in FIG. 1 and receive a roll pin at a location above upper pin stop 40. That roll pin will prevent removal of pin 35.

Pin 35 extends downwardly into first bore 26 to an end face 44. End face 44 is at a location between inlet 29 and outlet 30. In a most preferred embodiment of the present invention, end face 44 is at a position between inlet 29 and outlet 30 such that the cross-sectional flow area between first bore 26 and end face 44 at the location of end face 44 is approximately equal to the flow area of outlet 30. This location can be easily determined provided the decreasing angle of first bore 26 is known. In a disclosed embodiment, this angle is 17 degrees. Further, end face 44 is preferably of approximately the same cross-sectional area as outlet 30. The above cross-sectional areas are all measured in a plane perpendicular to the center axis of first bore 26.

A chamfered groove 41 is formed in pin securing member 32 to receive pin 35 at upper pin stop 40. Chamfered groove 41 guides pin 35 as it floats to center itself.

Figure 2:
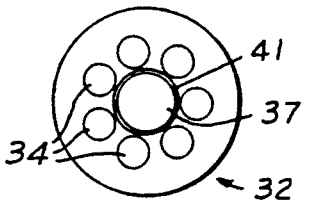
FIG. 2 is an end view of a pin securing member according to the present invention.

Pin securing member 32 is illustrated in FIG. 2 including a plurality of ports 34 spaced circumferentially about, and radially outwardly of pin aperture 37. Ports 34 pass fluid such as water from an upstream fluid supply into first bore 26. As fluid passes over pin 35, its pressure drops and cavitation bubbles form. The fluid jet leaves housing outlet 31 and impinges upon a surface to be cleaned. The bubbles implode and clean the surface.

Figure 3:
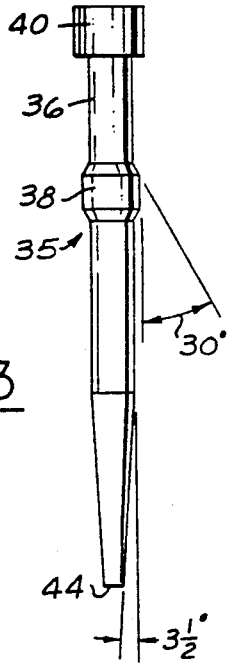
FIG. 3 is a side view showing a pin according to the present invention.

FIG. 3 is a side view of pin 35 according to the present invention. Pin securing portion 36 is located between lower pin stop 38 and upper pin stop 40. End face 44 is the lowermost extent of pin 35. As shown, lower pin stop 38 flares outwardly to wedge into central aperture 37 at an angle, in the disclosed embodiment 30 degrees. Also, the lower extent of pin 35 converges conically inwardly at a slight angle to end face 44, in the disclosed embodiment 3½ degrees.

Figure 4:
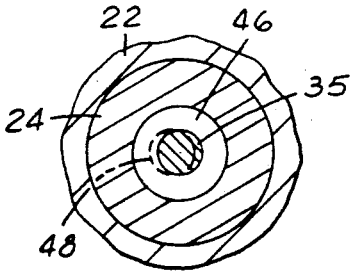
FIG. 4 is a fragmentary cross-sectional view along lines 4—4 as shown in FIG. 1.

FIG. 4 illustrates the Lomakin effect which ensures that pin 35 will be approximately self-centered within first bore 26. Pin 35 is received within flow area 46 defined by first bore 26. Should pin 35 move off to the left of a center line position to displaced position 48, the pressure to the left of pin 35 will become greater than the pressure to the right of pin 35. A force is then applied to pin 35 urging it back to the right to the center line position. Since pin 35 in the inventive nozzle 20 is free-floating within pin securing member 32, pin 35 moves easily back to the center position and remains centered on a center axis of first bore 26.

Figure 5:
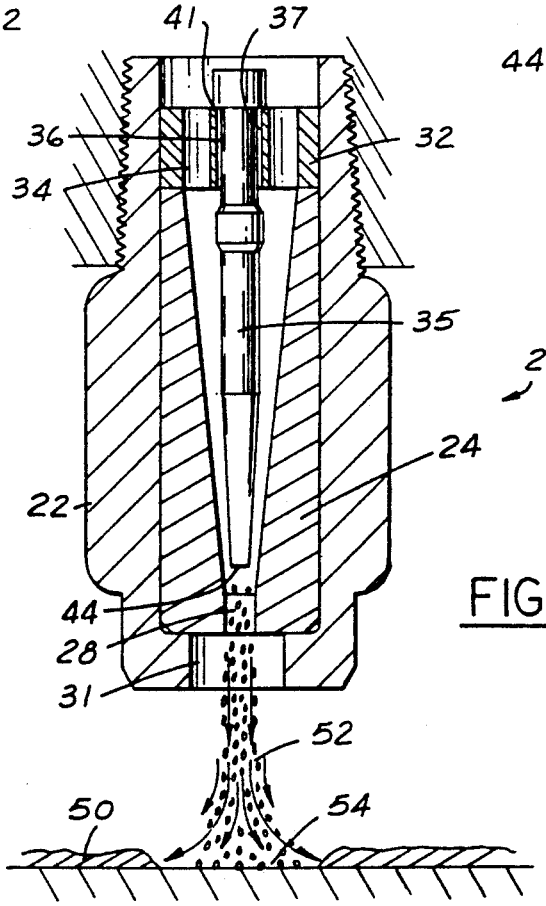
FIG. 5 is a cross-sectional view similar to FIG. 1 and showing a fluid jet leaving the nozzle to clean a surface.

FIG. 5 illustrates cavitating nozzle 20 being used to clean surface 50. Surface 50 has a coating of paint, rust or scale that is to be removed. Fluid jet 52 leaves housing outlet 31 and impinges on surface 50. The cavitation bubbles and the jet remove the paint, rust or scale such that a clean surface 54 remains.

In a most preferred embodiment, at least one of the pin or throat is formed of tungsten carbide, the other may be stainless steel.

With a nozzle according to the present invention, cavitation bubbles ensure a surface is thoroughly cleaned and all rust, scale or other coatings are removed, and when used to clean a metal surface the fluid jet cleans down to the bare metal. This is known as white metal cleaning. In addition, it is not necessary to include abrasives in the fluid jet. The pressurized fluid, which is preferably water, can clean the surface on its own.

A preferred embodiment of the present invention has been disclosed, however, a worker of ordinary skill in the art would realize that certain modifications would come within the scope of this invention, thus, the following claims should be studied in order to determine the true scope and content of the present invention.

I claim:

1. A cavitating nozzle comprising:

a throat having a first bore centered about an axis, said axis extending in said first bore from an inlet to an outlet, said inlet defining a greater cross-sectional area in a plane drawn perpendicular to said axis than said outlet; and a pin extending axially between two end portions and received in said first bore, a first end portion being retained within said bore adjacent said inlet, a second end portion extending from said first end portion toward said outlet, said pin being free-floating relative to said throat throughout its axial length such that said pin may be self-centering on said axis throughout its axial length.

2. A cavitating nozzle as recited in claim 1, wherein a pressurized fluid flow from said inlet to said outlet passes through a passage between the outer periphery of said pin and the inner-periphery of said first bore.

3. A cavitating nozzle as recited in claim 2, wherein said first bore conically converges from said inlet to said outlet, and said pin has an end face between said inlet and said outlet.

4. A cavitating nozzle as recited in claim 3, wherein the cross-sectional area of said outlet located in a plane drawn perpendicular to said axis, is approximately equal to the cross-sectional area between the inner-periphery of said bore and the outer periphery of said pin at said end face, also located in a plane drawn perpendicular to said axis.

5. A cavitating nozzle as recited in claim 4, wherein said pin is received in a pin securing member mounted above said throat, said pin securing member extending radially inwardly over said inlet, said pin securing member including a central aperture for receiving said first portion of said pin, said central aperture being of a first diameter and said pin first portion having an outer periphery of a second diameter which is smaller than said first diameter such that there is a clearance between said pin and said central aperture, and said pin is free-floating within said pin securing member.

6. A cavitating nozzle as recited in claim 5, wherein said pin securing member including a plurality of flow passages spaced radially outwardly from said central aperture and providing passages to allow flow of pressurized fluid from said inlet to said outlet.

7. A cavitating nozzle as recited in claim 6, wherein said nozzle is provided with portions that prevent said pin from moving outwardly of said central aperture.

8. A cavitating nozzle as recited in claim 1, wherein said first bore conically converges from said inlet to said outlet, and said pin has an end face between said inlet and said outlet.

9. A cavitating nozzle as recited in claim 1, wherein a second bore extends from said first bore outlet, said second bore being of the same cross-sectional area as said outlet throughout its extent.

10. A cavitating nozzle comprising:

a throat having a first bore centered about an axis, said axis extending in said first bore from an inlet to an outlet, said inlet defining a greater cross-sectional area in a plane drawn perpendicular to said axis than said outlet;

a pin received in said first bore, said pin being free-floating relative to said throat such that said pin may be self-centering on said axis;

said first bore conically converging from said inlet to said outlet, said pin having an end face between said inlet and said outlet; and the cross-sectional area of said outlet located in a plane drawn perpendicular to said axis being approximately equal to the cross-sectional area between the inner-periphery of said first bore and the outer periphery of said pin at said end face, also located in a plane drawn perpendicular to said axis.

11. A cavitating nozzle comprising:

a throat having a first bore centered about an axis, said axis extending in said first bore from an inlet to an outlet;

a pin securing member positioned above said throat and extending radially inwardly above said inlet, said pin securing member including a central aperture of a first diameter; and a pin extending axially between two end portions and having a first end portion received in said central aperture, said pin extending from said first end portion downwardly towards said outlet of said first bore, said first end portion having an outer periphery of a second diameter smaller than said first diameter, such that said pin is free-floating within said pin securing member and throughout its axial length relative to said throat, and such that said pin may be self-centering on said axis.

12. A cavitating nozzle as recited in claim 11, wherein said first bore conically converges from said inlet to said outlet, and said pin has an end face between said inlet and said outlet.

13. A cavitating nozzle as recited in claim 12, wherein the cross-sectional area of said outlet located in a plane drawn perpendicular to said axis, is approximately equal to the cross-sectional area between the inner-periphery of said first bore and the outer periphery of said pin at said end face, also located in a plane drawn perpendicular to said axis.

14. A cavitating nozzle as recited in claim 11, wherein said pin securing member is fixed above said throat by an adhesive.

15. A cavitating nozzle as recited in claim 11, wherein said pin is received in a chamfered portion of said pin securing member.

16. A cavitating nozzle comprising:

a throat having a first bore centered about an axis, said axis extending in said first bore from an inlet to an outlet, said inlet being of a greater cross-sectional area in a plane drawn perpendicular to said axis than the cross-sectional area of said outlet, and said first bore conically converging from said inlet to said outlet;

a pin securing member mounted in abutting relationship above said throat and having a central aperture; and a pin extending along an axis between a first end portion and a second end portion and received within said central aperture, said pin being retained within said bore adjacent said first end portion, said pin having an end face adjacent said second end portion and between said inlet and said outlet, and wherein said pin is free-floating relative to said throat throughout its axial length such that said pin is self-centering on said axis.

17. A cavitating nozzle as recited in claim 16, wherein a second bore extends from said first bore outlet, said second bore being of the same cross-sectional area as said outlet throughout its extent.

18. A cavitating nozzle as recited in claim 16, wherein the cross-sectional area of said outlet located in a plane drawn perpendicular to said axis, is approximately equal to the cross-sectional area between the inner-periphery of said first bore and the outer periphery of said pin at said end face, also located in a plane drawn perpendicular to said axis.

19. A cavitating nozzle as recited in claim 16, wherein said pin securing member is fixed by an adhesive.

* * * * *